United States Patent [19]

Tonkin

[11] 3,946,888

[45] Mar. 30, 1976

[54] ARTIFICIAL BABY FEEDING

[76] Inventor: Shirley Lyford Tonkin, 27 Eastbourne Road, Auckland 5, New Zealand

[22] Filed: Dec. 7, 1973

[21] Appl. No.: 422,847

[30] Foreign Application Priority Data

Dec. 7, 1972 New Zealand ..... 169254

[52] U.S. Cl. ..... 215/11 B; 215/11 D

[51] Int. Cl.[2] ..... A61J 9/00

[58] Field of Search ..... 128/252; 215/11 R, 11 B, 215/11 D, 311; 137/525.3

[56] References Cited

UNITED STATES PATENTS

| | | | |
|---|---|---|---|
| 249,557 | 11/1881 | Truesdell | 137/525.3 |
| 589,212 | 8/1897 | Michael | 128/252 |
| 605,161 | 6/1898 | Clement | 128/252 |
| 1,099,082 | 6/1914 | Decker | 128/252 |
| 1,146,639 | 7/1915 | Miller | 215/11 B UX |
| 1,683,246 | 9/1928 | Griffiths | 128/252 |
| 2,597,483 | 5/1952 | Head | 215/11 D X |
| 2,655,279 | 10/1953 | Wolf | 215/11 B |
| 2,707,470 | 5/1955 | Greene | 128/252 |
| 2,742,168 | 4/1956 | Panetti | 215/11 D |
| 2,876,773 | 3/1959 | Witz | 128/252 |
| 3,346,133 | 10/1967 | Herdman | 215/11 R |
| 3,424,157 | 1/1969 | DiPaolo | 128/252 |

*Primary Examiner*—Donald F. Norton

[57] ABSTRACT

Artificial baby feeding apparatus for use with a container and teat has a flow directing means in the form of a one way valve or a restriction to prevent or restrict backflow of liquid from the teat to the container. A teat having a soft toroidal distal proximal portion assists in giving a satisfactory pumping action.

5 Claims, 3 Drawing Figures

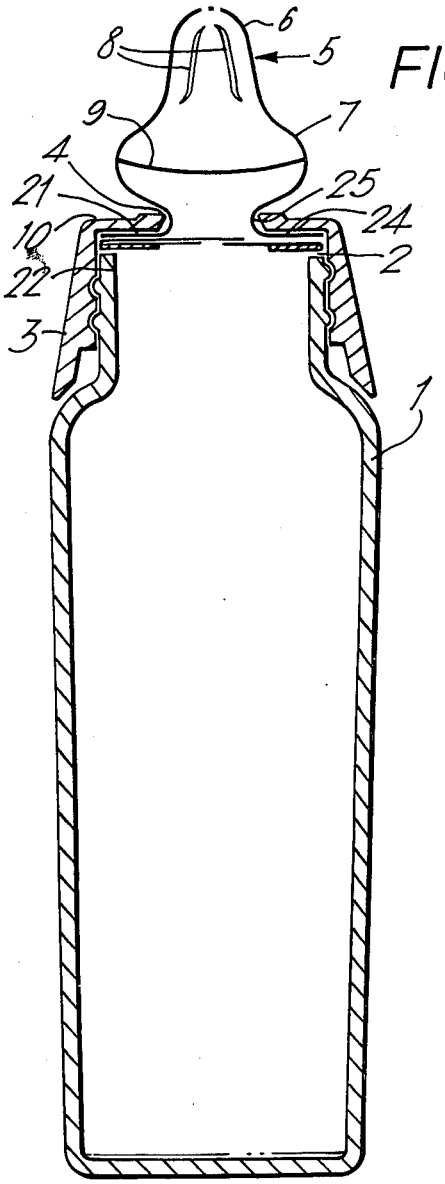
FIG.1.
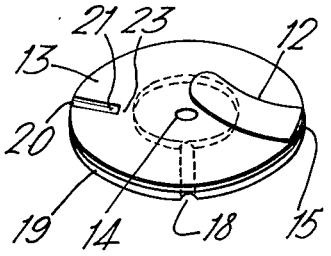
FIG.2.
FIG.3.
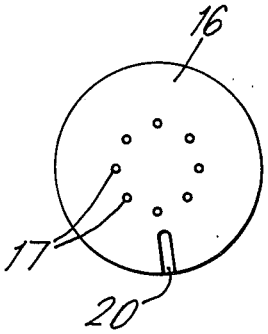

ARTIFICIAL BABY FEEDING

BACKGROUND OF THE INVENTION

This invention relates to artificial baby feeding.

I believe that there is a considerable difference between a baby's actions in suckling at the breast and sucking liquid from the artificial teats used on baby's bottles. In the first action, there is largely a biting action followed by a swallowing action, whereas in the second, it is necessary for the baby to create a negative pressure in its mouth before liquid, e.g. milk, can be caused to be drawn from the bottle by sucking. Not only this, but the bottle must be removed from the baby's mouth on occasions to allow air to enter into the bottle to replace the milk taken from the bottle by the baby. This has caused considerable disadvantages in the past in that some babies, particularly weak babies, do not quickly learn the necessary sucking action and it is believed that there are other physiological disadvantages in the present artificial baby feeding techniques.

OBJECTS AND SUMMARY OF THE INVENTION

It is therefore an object of the present invention to provide baby feeding methods and/or apparatus which will obviate or minimize the foregoing disadvantages in a simple yet effective manner or which will at least provide the public with a useful choice.

Accordingly, in one aspect, the invention consists in artificial baby feeding apparatus for use with a container and a teat, said apparatus comprising a flow directing means positioned, in use, between the container and the teat and pressure equalizing means adapted to prevent material negative pressure in the container during use, the construction and arrangement being such that, in use, milk or other liquid food supplied to the teat from the container may be expressed from the teat by squeezing parts of the teat towards each other while the container is elevated above the teat, milk flowing into the teat through said one way flow directing means on the teat distending after each compression and said pressure equalizing means operating to maintain substantially the same pressure inside as outside said container, with said flow directing means restricting or preventing flow of liquid back from the teat into the container.

In a further aspect, the invention consists in artificial baby feeding apparatus for use with a container, said apparatus comprising a teat fitted in use to the container, a flow directing means positioned, in use, between the container and the teat and pressure equalizing means adapted to prevent material negative pressure in the container during use, the construction and arrangement being such that, in use, milk or other liquid food supplied to the teat from the container may be expressed from the teat by squeezing parts of the teat towards each other while the container is elevated above the teat, milk flowing into the teat through said one way flow directing means on the teat distending after each compression and said flow directing means restricting or preventing flow of liquid back from the teat into the container.

To those skilled in the art to which this invention relates, many changes in construction and widely differing embodiments and applications of the invention will suggest themselves without departing from the scope of the invention as defined in the appended claims. The disclosures and the description herein are purely illustrative and are not intended to be in any sense limiting.

One preferred form of the invention and modifications thereof will now be described with reference to the accompanying drawings.

BRIEF DESCRIPTION OF THE DRAWINGS

FIG. 1 is a vertical diagrammatic part cross section of a baby's feeding bottle associated teat and including apparatus according to the invention, FIG. 2 is a perspective view of a valve used in the invention, and, FIG. 3 is a plan view of an alternative perforated diaphragm used in the invention.

DETAILED DESCRIPTION OF THE INVENTION

Referring to the drawings, in one form of the invention, apparatus for the artificial feeding of a baby from a container is constructed as follows. The container e.g. a bottle 1 for liquid food, for example, milk is constructed in the normal way, except that an opening 2 may be provided e.g. a slot 2 adjacent the bottle mouth and open to atmosphere so that air may be admitted into the container. This preferred way of admitting air will, however, be referred to later. The container is preferably provided with a screw top 3, with the top having an aperture 4 through which a teat 5 may be fitted so that the teat is sealed to the top of the container with the exception of the air opening through slot 2. The teat is preferably arranged to have a harder nipple 6 than an adjacent part 7 of the teat which is softer to conform to the softer part of the breast adjacent the nipple in nature. This may be effected by having a thinner cross section of flexible material e.g. rubber in the softer part than in the harder nipple part. It may also be effected by shaping the softer part e.g. to a toroidal or other suitable form. The part 7 is shown as of toroidal form in FIG. 1 separated by a neck 25 from a base 24 of the teat 5, and/or the teat may have stiffening ribs 8 and a stiffening ring 9 to control collapsing of the teat in use. Flow directing means are provided, for example, a one way valve is fitted between the bottle 1 and the teat 5 and preferably this one way valve is in the form of a flap valve 12 (FIG. 2), integral with a cover 13 having an aperture 14 therein, with the flap valve 12 fitting, in use, on the upper face of the cover 13 and over the aperture 14 and being movable by liquid flow or pressure changes to allow the flow of liquid from the bottle 1 to the teat 5 but not vice versa. The cover 13 and flap valve 12 may be made of any suitable material, for example, rubber, but is preferably made of a plastic material, such as polyethylene or polypropylene and the flap valve 12 may be either a separate member fixed to the cover, for example, by heat sealing along a line or may be integral with the cover 13 as shown, with the cover and flap valve being cut out of a sheet of material and then the flap folded over on a fold line 15 coinciding with the edge of the cover 13 so that the flap extends over the aperture 14. To provide pressure equalizing means to equalize pressure as between the inside and outside of the bottle, a collapsible container may be used but I prefer to admit air to the bottle e.g. by the slot or groove 2 or in place of the groove 2 on the bottle 1, a groove 18 may be provided in a washer 19 (FIG. 2).

The preferred way of admitting air into the bottle, however, is to provide a slot or slit 20 in the cover 13 or cover 16 (FIG. 3) which extends to a point 21 (FIGS. 1 and 2) which is inside inner face 22 of the bottle 1 but leaving a portion 23 of the cover still covered by part of an annular disc base 24 of the teat 5 so that air does not enter the teat but enters the bottle 1 beyond washer 19 and which is shown as an alternate arrangement in FIG. 2 to the groove 18. Thus, the slot 20 extends from outside the bottle to within the same.

So that a user will know which way is up to use the cover 13 and flap valve 12 it may be either colored or have printing thereon, the printing for example, reading "this side up" and the color coding being prescribed in the package in which the cover 13 and flap valve are supplied.

The flow directing means above described may, of course, take other forms, it may for example comprise a ball valve and valve seat or may comprise a "tear" type of valve in which a plurality of segments of a valve are arranged on a curved surface, so that pressure from one side will cause them to open away from each other, and pressure from the other side will cause them to close to each other, or the valve may comprise a mitral or aortal type of valve or may comprise a series of flap valves disposed adjacent to each other, or any other convenient type of one way valve may be used. This valve may be replaced by any flow directing means which resists back flow of liquid into the container when the teat is compressed. The preferred alternative device consists of a disc 16 which has a series of perforations 17 provided therein. These may be normal or oblique to the disc 16.

The teat, as stated, preferably has a hard nipple portion adjacent a softer rear portion to give a natural action. The distal hardening may be by a thicker portion of rubber or thickened lines. The proximal dilated portion has annular thickenings to facilitate its restoration after compression.

The operation of the construction is as follows:

When the nipple is applied to a baby's mouth, the natural suckling action of the baby is to bite or chew at the nipple compressing and releasing the nipple. The compression of the nipple causes milk or other liquid contained therein to be squirted from the aperture or apertures in the teat into the baby's mouth. Because of the one way action when the baby's mouth releases the teat, it expands because of the resilience of the material and this draws further milk into the teat, with this milk coming, of course, from the bottle 1. The milk which has thus been removed from the bottle, then creates a slight reduction in pressure in the bottle which draws air into the bottle through groove 2, groove 18 or slot 20 (FIGS. 2 or 3) and this action continues. Of course, the bottle is maintained above the teat in normal use so that the flow of milk is effected by gravity and reverse flow of milk from the teat back into the bottle is prevented or restricted by the flow restricting means.

The construction has many advantages, in particular it is believed that the simulated action is substantially the same as that in natural feeding so that no new technique has to be learned by a baby and consequently weak babies and others who find it difficult to learn artificial feeding can readily be artificially fed. Furthermore, it is believed that the sucking action may have some detrimental physiological action on the baby and consequently from this point alone the construction is justified.

Furthermore, a good flow of milk is provided and there is little likelihood of the baby taking in air with his milk.

I claim:

1. Apparatus for nursing a suckling infant comprising in combination a container for containing a liquid and having an open end through which the liquid is dispensed as the infant suckles; a separate cover element disposed transversely of said container's open end; a teat element axially above said cover element and including means through which the liquid is received by the suckling infant; means removably retaining the container, cover element and teat element in assembled relationship; means for venting the interior of said container to the atmosphere as liquid is withdrawn by the suckling infant, said cover element comprising a disc including an aperture through which liquid flows from the container to the teat element as an infant suckles, said disc including a one-way valve comprising a displaceable flap juxtaposed on the side of said disc adjacent the teat element, said flap including a valve portion normally overlying said aperture for permitting liquid to flow thereby only from the container to the nipple element and preventing reverse liquid flow back to the container from the nipple element, said means for venting the interior of said container to the atmosphere comprising an air passage means formed between cooperating portions of said container and said cover element and comprising at least one groove portion in a washer positioned between said container and said cover element.

2. Apparatus as claimed in claim 1 wherein said teat element comprises a resiliently flexible material and includes a disc-like base overlying said cover element and integral with a toroidal portion extending axially from said disc-like base above the cover element and having a relatively large diameter, the toroidal portion being connected by a necked portion of relative smaller diameter to a nipple disposed above said toroidal portion, said nipple having a conoid formation, the nipple being harder and stiffer than the adjacent toroidal portion and being operative to substantially collapse during nursing of the infant whereby the toroidal portion collapses and expands to create a pumping action through said one-way valve.

3. The apparatus as claimed in claim 2 in which said conoid formation comprises a plurality of stiffening ribs integral with said nipple, said ribs lying in planes which extend along the axis of said nipple.

4. The apparatus as claimed in claim 1 in which the displacable flap of said one-way valve is integral with and comprises a portion of said cover element in reversed overlying relationship to the side of said cover element adjacent said teat element.

5. The apparatus as claimed in claim 1 wherein said means for removably retaining the container, cover element and teat element in assembled relationship comprises a cap element removably secured to cooperating portions of said container.

* * * * *